US010632340B2

(12) United States Patent
Li

(10) Patent No.: US 10,632,340 B2
(45) Date of Patent: Apr. 28, 2020

(54) TREADMILL

(71) Applicant: REXON INDUSTRIAL CORP., LTD., Taichung (TW)

(72) Inventor: Wen Tu Li, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 142 days.

(21) Appl. No.: 15/867,843

(22) Filed: Jan. 11, 2018

(65) Prior Publication Data

US 2018/0200568 A1 Jul. 19, 2018

(30) Foreign Application Priority Data

Jan. 19, 2017 (TW) ..... 106101863 A

(51) Int. Cl.
*A63B 22/02* (2006.01)
*A63B 22/00* (2006.01)

(52) U.S. Cl.
CPC ..... *A63B 22/0235* (2013.01); *A63B 22/0023* (2013.01); *A63B 22/02* (2013.01); *A63B 2210/00* (2013.01); *A63B 2210/50* (2013.01); *A63B 2210/56* (2013.01)

(58) Field of Classification Search
CPC . A63B 22/0023; A63B 22/02; A63B 22/0235; A63B 2210/00; A63B 2210/50; A63B 2210/56
See application file for complete search history.

(56) References Cited

U.S. PATENT DOCUMENTS 6,758,791 B1 * 7/2004 Kuo ..... A63B 22/0023 482/54
7,357,758 B2 * 4/2008 Polk, III ..... A63B 22/0023 482/54
7,722,507 B2 * 5/2010 Yoo ..... A63B 22/0023 482/51
7,883,448 B2 * 2/2011 Wang ..... A63B 22/0235 482/54

(Continued)

FOREIGN PATENT DOCUMENTS

TW 283956 9/1996
TW I458254 B 10/2014

(Continued)

OTHER PUBLICATIONS

Taiwanese Office Action of Taiwanese Patent Application No. 106101863, dated Jun. 27, 2017.

*Primary Examiner* — Joshua Lee
(74) *Attorney, Agent, or Firm* — Bacon & Thomas, PLLC

(57) ABSTRACT

A treadmill includes a frame, a driving member and a running belt. The frame includes a base, a front rotating shaft and a rear rotating shaft. The driving member has a motor and a transmission member drivable by the motor. The motor is installed between the front rotating shaft and the rear rotating shaft and is located adjacent to the front rotating shaft. The transmission member is adapted for driving the front rotating shaft to rotate. The running belt winds around the front rotating shaft and the rear rotating shaft, and is drivable by the motor to rotate relative to the base. By installing the motor between the front rotating shaft and the rear rotating shaft, an overall length and size of the treadmill is reduced for minimizing storage space.

13 Claims, 8 Drawing Sheets

(56) References Cited

U.S. PATENT DOCUMENTS 9,044,638 B2 * 6/2015 Huang ..... A63B 22/0235
9,352,185 B2 * 5/2016 Hendrickson ..... A63B 22/0023
9,452,315 B1 * 9/2016 Murray ..... A63B 22/02
9,707,441 B2 * 7/2017 Yang ..... A63B 22/02
9,849,330 B2 * 12/2017 Lagree ..... A63B 21/023
2004/0087417 A1 * 5/2004 Lo ..... A63B 22/02 482/54
2004/0138030 A1 * 7/2004 Wang ..... A63B 22/0023 482/54
2005/0037899 A1 * 2/2005 Wu ..... A63B 22/0023 482/54
2005/0096189 A1 * 5/2005 Chen ..... A63B 22/0023 482/54
2005/0159273 A1 * 7/2005 Chen ..... A63B 22/02 482/54
2005/0239607 A1 * 10/2005 Chang ..... A63B 22/0023 482/54
2006/0058160 A1 * 3/2006 Lee ..... A63B 22/0023 482/54
2006/0142125 A1 * 6/2006 Pan ..... A63B 22/0023 482/54
2008/0070756 A1 * 3/2008 Chu ..... A63B 22/02 482/54
2008/0188358 A1 * 8/2008 Kuo ..... A63B 22/02 482/54
2009/0124465 A1 * 5/2009 Wang ..... A63B 22/02 482/54
2009/0137367 A1 * 5/2009 Hendrickson ..... A63B 21/0051 482/54
2009/0176627 A1 * 7/2009 Wang ..... A63B 22/0023 482/54
2012/0165162 A1 * 6/2012 Lu ..... A63B 22/0235 482/54
2013/0267386 A1 * 10/2013 Her ..... A63B 22/02 482/54
2016/0166870 A1 * 6/2016 Lagree ..... A63B 21/023 482/142
2017/0106233 A1 * 4/2017 Yang ..... A63B 22/02
2019/0240530 A1 * 8/2019 Lagree ..... A63B 22/0023

FOREIGN PATENT DOCUMENTS

TW I458254 S 10/2014
TW M505320 U 7/2015
TW M511879 U 11/2015

* cited by examiner

TREADMILL

BACKGROUND OF THE INVENTION

1. Field of the Invention

The present invention relates to exercise equipment and more particularly, to a treadmill.

2. Description of the Related Art

An electric treadmill basically comprises a frame, a driving member and a running belt.

Taiwan Patent Number 1458254 discloses a treadmill, which comprises a frame, a front roller and a rear roller respectively pivotally mounted to opposing front and rear ends of the frame, a running belt mounted around the front roller and the rear roller, and a driving member that comprises a motor mounted at a front side relative to the front roller and adapted for driving the front roller to rotate the running belt.

Further, a slope control motor is mounted in a side space of the driving member at a front side relative to the front roller and operable to drive mating component parts in adjusting the slope of the frame.

The aforesaid prior art treadmill can achieve the expected effects, however, because the driving member and the slope control motor are mounted at a front side relative to the front roller, the overall length of the treadmill is large, and the overall volume of the treadmill is also large, occupying much packing, delivery and storage space.

Taiwan Patent Number M511879 discloses a similar treadmill design that has similar problems.

SUMMARY OF THE INVENTION

The present invention has been developed in view of the aforementioned circumstances. It is one of the main objects of the present invention to provide a treadmill, which effectively reduces the length and volume of a treadmill.

To achieve this and other objects of the present invention, a treadmill comprises a frame, a driving member and a running belt. The frame comprises a base, a front rotating shaft is pivotally located on the base, and a rear rotating shaft is pivotally located on the base. The front rotating shaft is corresponded to the front end portion. The rear rotating shaft is corresponded to the rear end portion. The driving member comprises a motor mounted between the front rotating shaft and the rear rotating shaft and located adjacent to the front rotating shaft, and a transmission member drivable by the motor to rotate the front rotating shaft. The running belt is mounted around the front rotating shaft and the rear rotating shaft, and drivable by the motor to rotate relative to the base.

The effect of the present invention is: Subject to the arrangement that the motor of the driving member is mounted between the front rotating shaft and the rear rotating shaft and located adjacent to the front rotating shaft, the treadmill effectively has a reduced overall length and volume. Thus, the treadmill in accordance with the present invention requires less installation space, which saves much packing, delivery and storage space and costs and provides a beautiful outer appearance.

Other advantages and features of the present invention will be fully understood by reference to the following specification in conjunction with the accompanying drawings, in which like reference signs denote like components of structure.

DETAILED DESCRIPTION OF THE INVENTION

Figure 1:
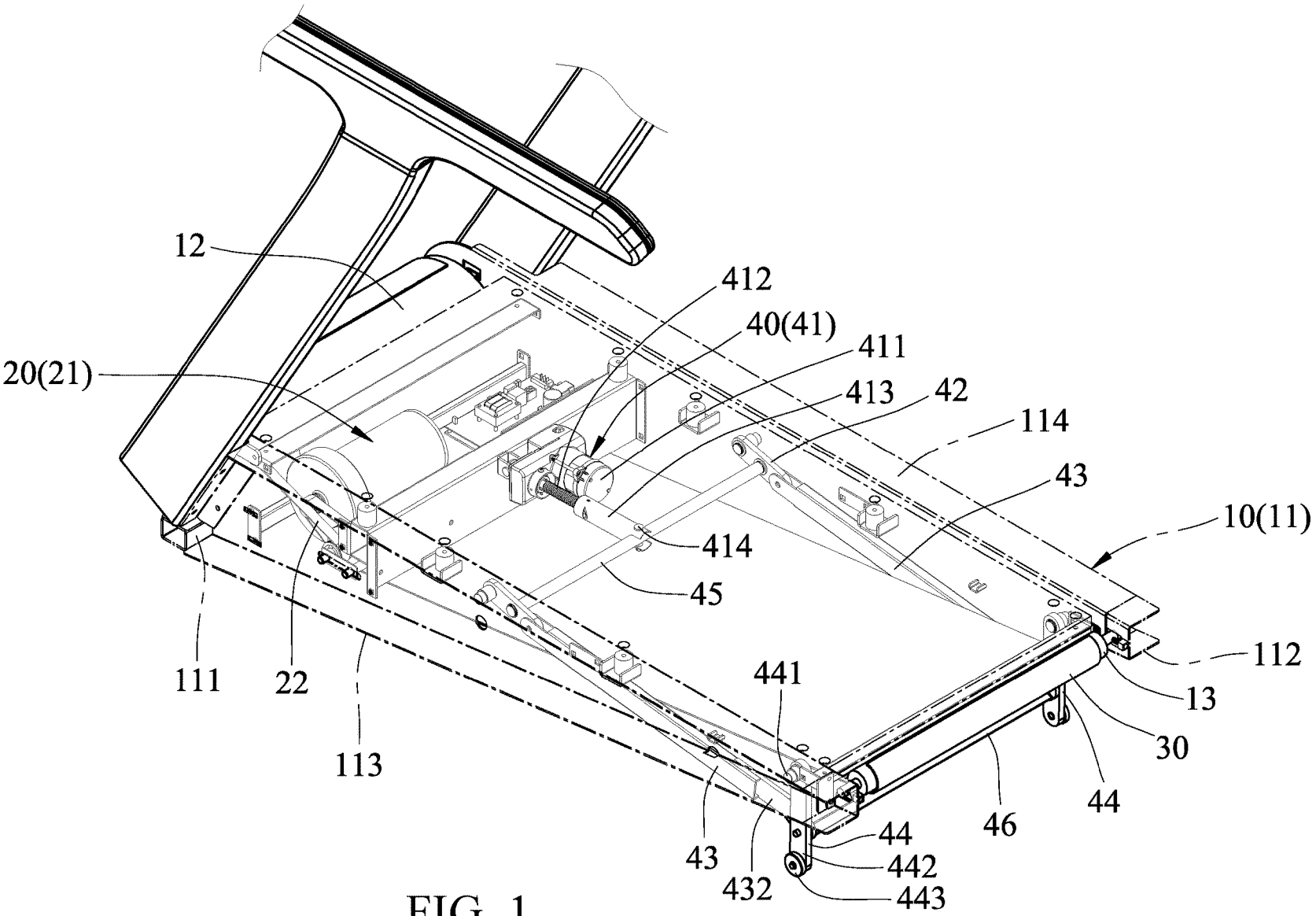
FIG. 1 is a schematic partial elevational assembly view of a treadmill in accordance with a first embodiment of the present invention.
Figure 2:
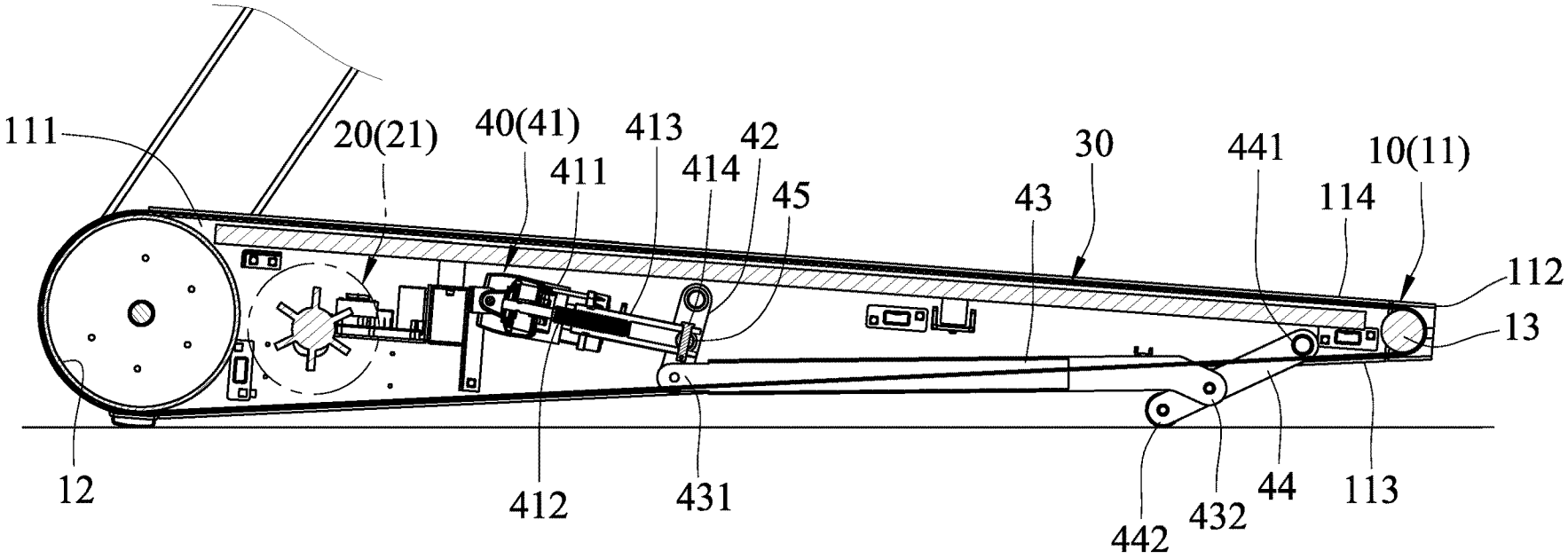
FIG. 2 is a sectional view of the treadmill in accordance with the first embodiment of the present invention.

Referring to FIGS. 1 and 2, a treadmill in accordance with a first embodiment of the present invention is shown. The treadmill comprises a frame 10, a driving member 20, a running belt 30 and a rear lifter 40.

The frame 10 comprises a base 11, a front rotating shaft 12 pivotally mounted to the base 11, and a rear rotating shaft 13 pivotally mounted to the base 11. The base 11 comprises a front end portion 111, a rear end portion 112 opposite to the front end portion 111, a bottom surface 113 extended from the front end portion 111 to the rear end portion 112, and a top surface 114 opposite to the bottom surface 113. The front rotating shaft 12 is pivotally connected to the front end portion 111 of the base 11. The rear rotating shaft 13 is pivotally connected to the rear end portion 112 of the base 11.

The driving member 20 comprises a motor 21 mounted between the front rotating shaft 12 and the rear rotating shaft 13 and disposed relatively closer to the front rotating shaft 12, and a transmission member 22 drivable by the motor 21 to rotate the front rotating shaft 12. In this embodiment, the transmission member 22 is a belt.

The running belt 30 is mounted around the front rotating shaft 12 and the rear rotating shaft 13, and drivable by the motor 21 to circulate on the base 11.

The rear lifter 40 is installed in the base 11 and adapted for lifting the rear end portion 112 of the base 11, comprising a rear actuator 41 rotatably mounted between the front rotating shaft 12 and the rear rotating shaft 13 adjacent the driving member 20, a pair of rear swinging rods 42 pivoted to the base 11 and drivable by the rear actuator 41 to bias relative to the base 11, a pair of rear links 43 respectively pivoted to the rear swinging rods 42, a pair of rear support rods 44 respectively pivoted to the base 11 for pivot connection with the respective rear links 43, a rear connection rod 45 connected between the rear swinging rods 42, a rear drag rod 46 connected between the rear links 43. The rear actuator 41 comprises a rear motor 411, a rear lead screw 412 rotatable by the rear motor 411, and a rear screw nut 413 threaded onto the rear lead screw 412.

The rear screw nut 413 comprises a rear pivot connection portion 414 pivotally connected to the rear connection rod 45. The rear links 43 each comprise a rear first end 431 respectively pivoted to the rear swinging rods 42, and a rear second end 432 opposite to the rear first end 431 and pivotally connected to the rear support rods 44. The rear support rods 44 are disposed adjacent to the rear end portion 112, each comprising a rear pivoting end 441 pivotally connected to the base 11, a rear swinging end 442 opposite to the rear pivoting end 441 and a rear roller 443 pivotally mounted to the rear swinging end 442. The rear second ends 432 of the rear links 43 are respectively pivotally coupled between the rear pivoting ends 441 and the rear swinging ends 442.

Figure 3:
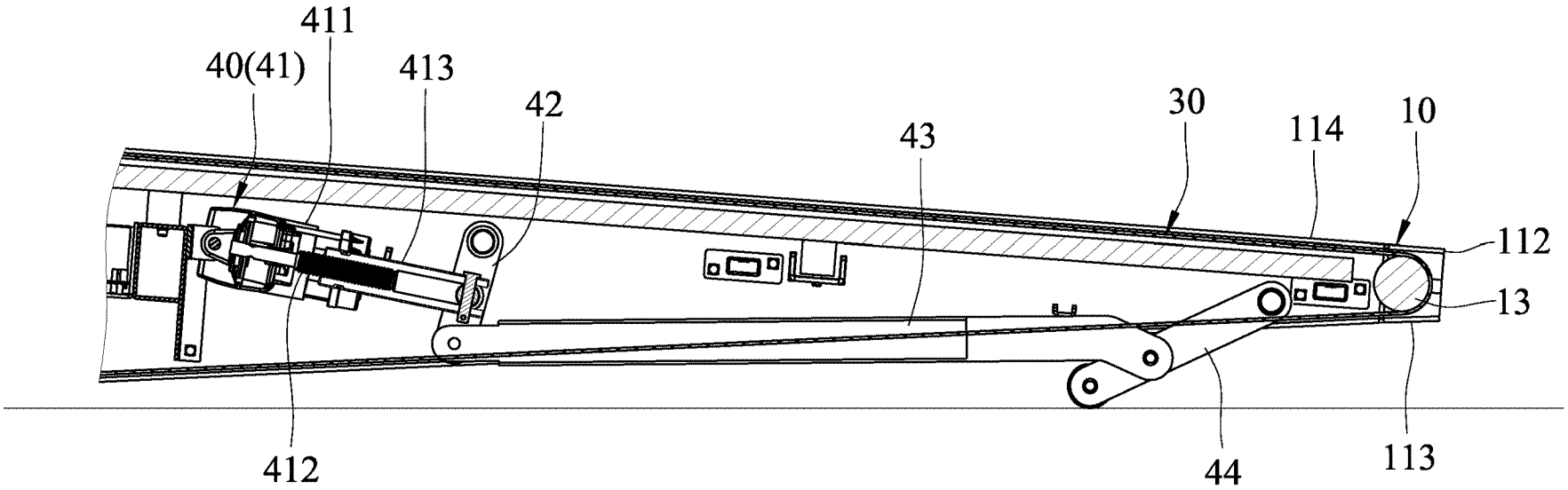
FIG. 3 is an enlarged view of a part of FIG. 2.

FIGS. 2 and 3 illustrate the rear lifter 40 in a received position where the bottom surface 113 of the base 10 defines with the floor a relatively smaller contained angle, and the top surface 114 has a greater slope relative to the floor.

Figure 4:
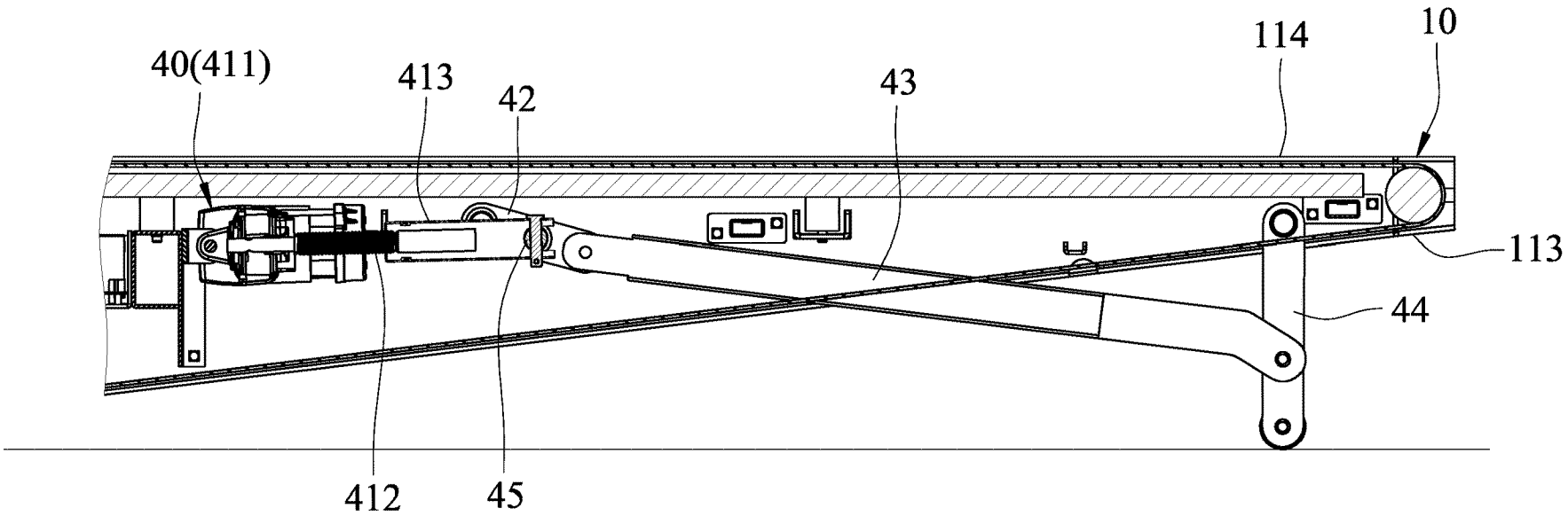
FIG. 4 is a schematic operational view of the rear lifter of the treadmill in accordance with the first embodiment of the present invention.

Referring to FIG. 4, when the rear motor 411 of the rear lifter 40 is activated, the rear motor 411 drives the rear lead screw 412 to rotate on its own axis, causing axial movement of the rear screw nut 413 along the rear lead screw 412 and swinging of the rear swinging rods 42 relative to the base 11. Upon swinging of the rear swinging rods 42, the rear links 43 are forced to bias the rear support rods 44 relative to the base 11, and thus, as illustrated in FIG. 4, the rear support rods 44 and the bottom surface 113 define therebetween the contained angle. When the contained angle defined between the bottom surface 113 and the floor reaches the maximum, the top surface 114 has a smaller slope with respect to the floor, e.g., parallel to the floor.

Thus, subject to the arrangement that the motor 21 of the driving member 20 is mounted between the front rotating shaft 12 and the rear rotating shaft 13 and disposed relatively closer to the front rotating shaft 12, the length and volume of the treadmill is minimized when compared to conventional treadmills that maintain the same distance between the front rotating shaft 12 and the rear rotating shaft 13. Thus, the treadmill in accordance with the first embodiment of the present invention has a good appearance and requires less installation space, which saves much packing, delivery and storage space and costs. Further, the arrangement of the rear lifter 40 allows adjustment of the slope of the treadmill.

Figure 5:
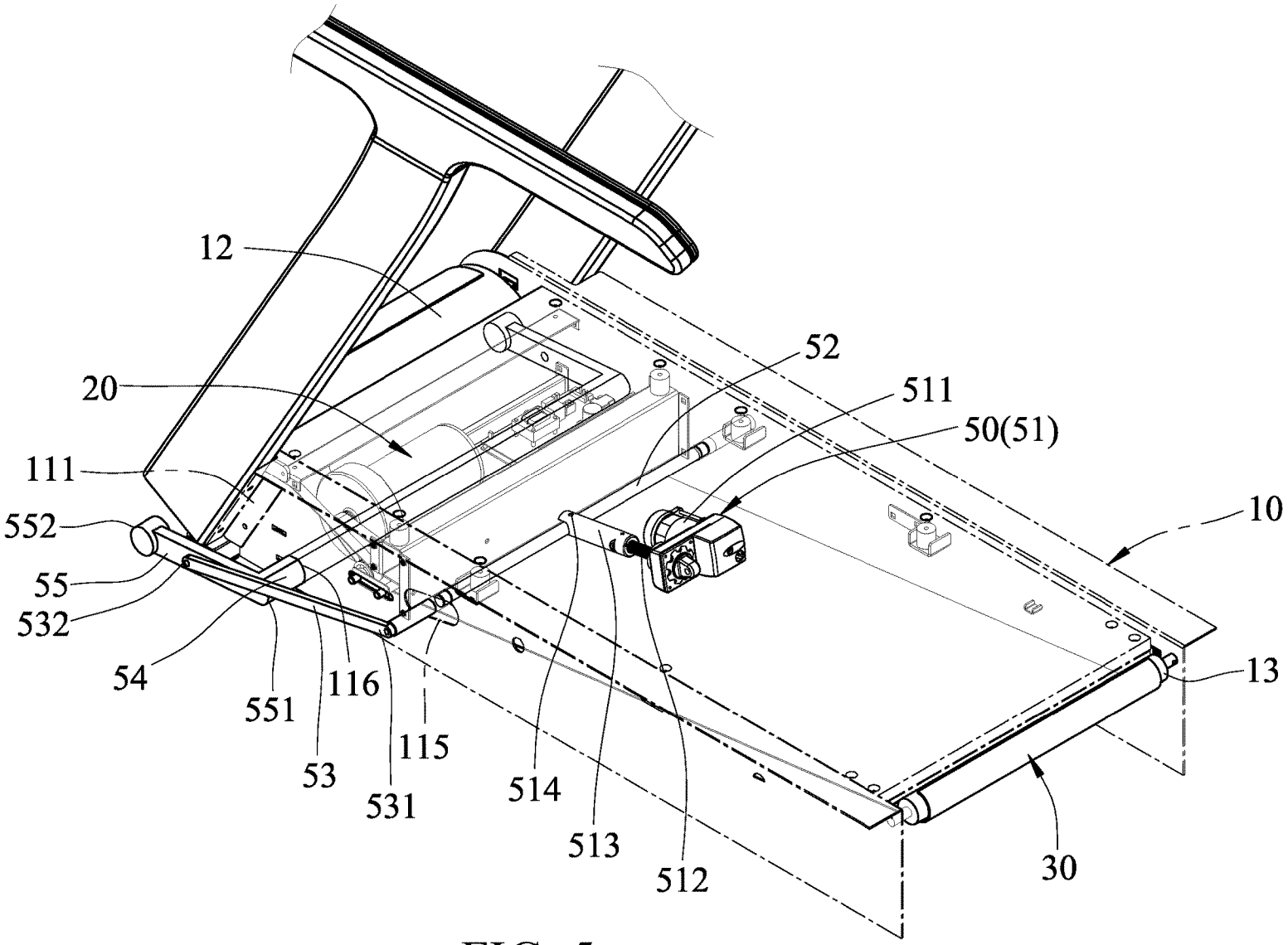
FIG. 5 is a schematic partial elevational assembly view of a treadmill in accordance with a second embodiment of the present invention.
Figure 6:
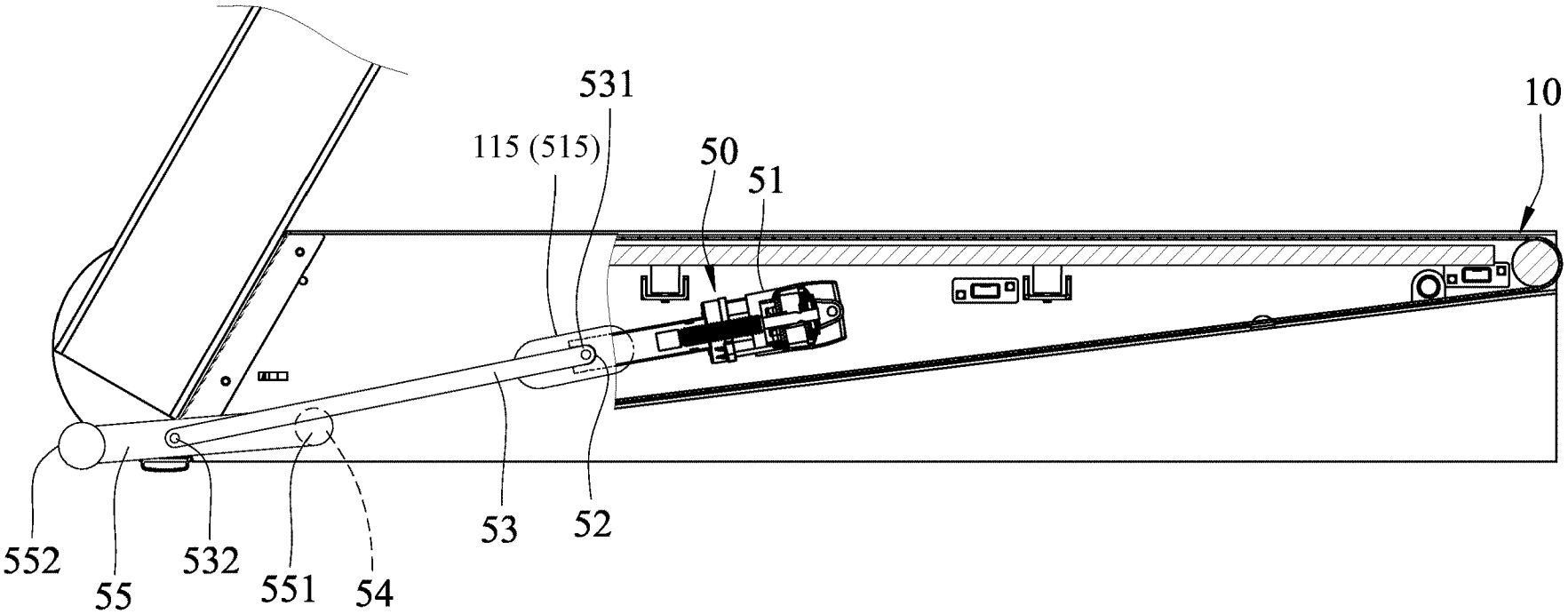
FIG. 6 is a sectional view of the treadmill in accordance with the second embodiment of the present invention.

Referring to FIGS. 5 and 6, a treadmill in accordance with a second embodiment of the present invention is shown. As illustrated, the treadmill of this second embodiment comprises a frame 10, a driving member 20, a running belt 30 and a front lifter 50. The frame 10, the driving member 20 and the running belt 30 are substantially similar to the like parts of the aforesaid first embodiment with the exception that the base 11 in accordance with this second embodiment further comprises a pair of sliding slots 115, and a pivot hole 116 disposed at one side relative to the sliding slots 115. Other structural details will not be described further. The motor 21 of the driving member 20 is also mounted between the front rotating shaft 12 and the rear rotating shaft 13 and disposed relatively closer to the front rotating shaft 12.

The front lifter 50 is mounted to the base 11 and adapted for lifting the front end portion 111 of the base 11. The front lifter 50 comprises a front actuator 51, a front connection rod 52 inserted through the sliding slot 115 and drivable to move relative to the base 11 by the front actuator 51, a pair of front links 53 respectively connected to the front connection rod 52, a front pivoting rod 54 rotatably pivoted to the pivot holes 116, and a pair of front support rods 55 connected to the front pivoting rod 54. The front actuator 51 comprises a front motor 511, a front lead screw 512 drivable to rotate on its own axis, and a front screw nut 513 threaded onto the front lead screw 512. The front screw nut 513 comprises a front pivot connection portion 514 pivotally connected to the front connection rod 52. The front links 53 each comprise a front first end 531 connected to the front connection rod 52, and a front second end 532 opposite to the front first end 531 and pivoted to the front second end 532 of one respective front support rod 55. The front support rods 55 are disposed adjacent to the front end portion 111, each comprising a front pivoting end 551 connected to the front pivoting rod 54 and a front swinging end 552 opposite to the front pivoting end 551. The front second ends 532 of the front links 53 are respectively pivotally connected between the front pivoting ends 551 and the front swinging ends 552.

Figure 7:
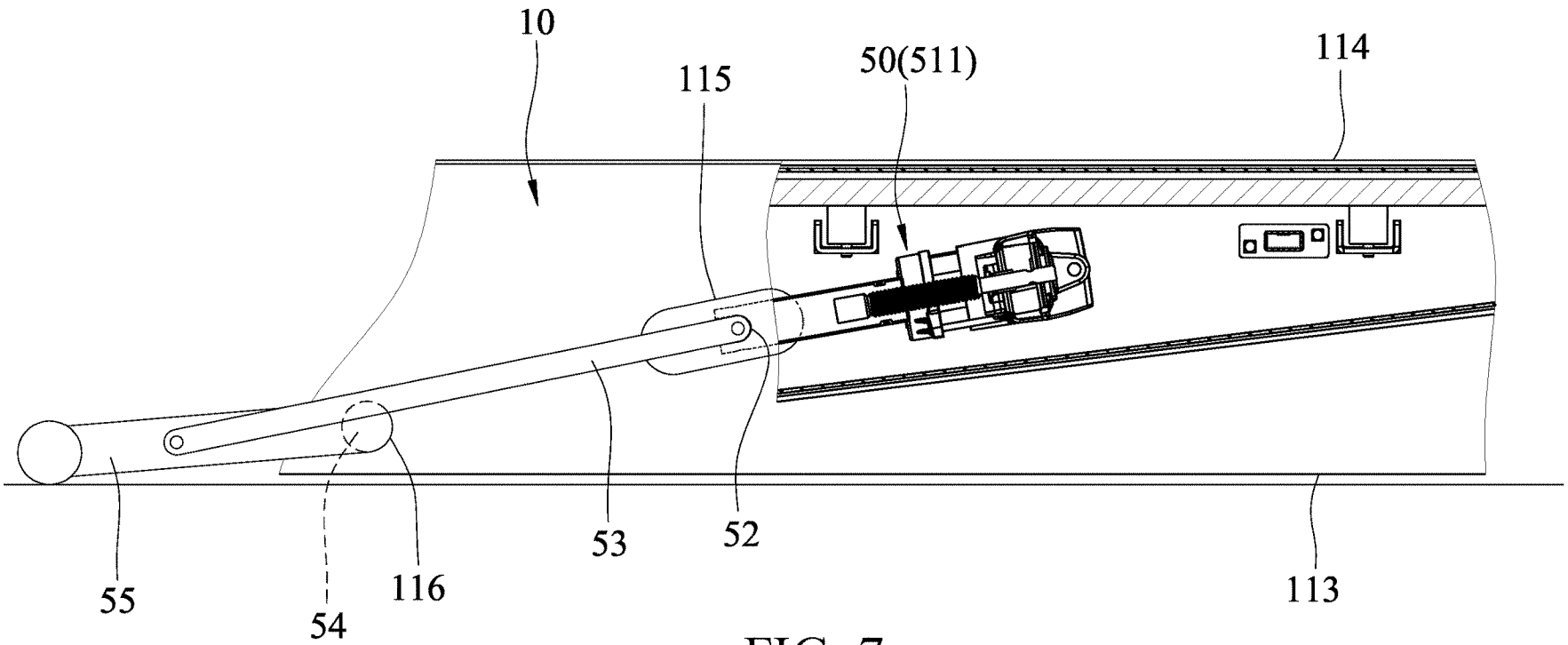
FIG. 7 is an enlarged view of a part of FIG. 6.

FIGS. 6 and 7 illustrate the front elevating mechanism 50 disposed in a received position relative to the base 11 where the bottom surface 113 of the base 11 defines with the floor a relatively smaller contained angle, and the top surface 114 has a relatively smaller slope with respect to the floor, e.g., parallel with the floor.

Figure 8:
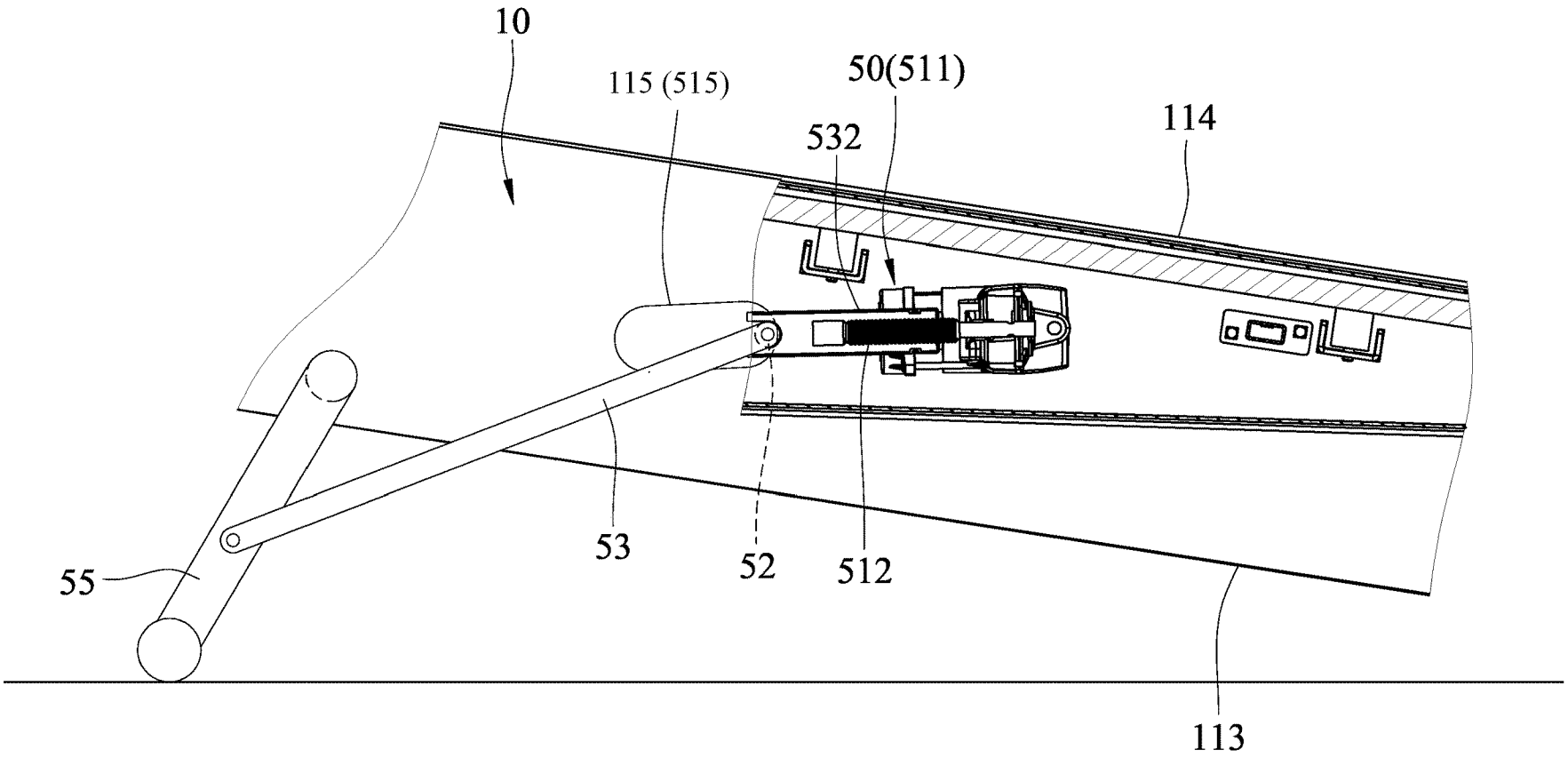
FIG. 8 is a schematic operational view of the front lifter of the treadmill in accordance with the second embodiment of the present invention.

Referring to FIG. 8, when the front motor 511 of the front elevating mechanism 50 is activated, the front motor 511 drives the front lead screw 512 to rotate, causing axial movement of the front screw nut 513 along the front lead screw 512. During axial movement of the front screw nut 513 along the front lead screw 512, the front screw nut 513 drives front connection rod 52 to shift along the chute 515, and drives the front links 53 pull the front support rods 55 to rotate relatively to the base 11. As illustrated in FIG. 8, when the front support rods 55 and the bottom surface 113 define therebetween a contained angle, the contained angle defined between the bottom surface 113 and the floor reaches the maximum, and at this time, the top surface 114 has a relatively larger slope with respect to the floor.

Subject to the arrangement that the motor 21 of the driving member 20 is mounted between the front rotating shaft 12 and the rear rotating shaft 13 and disposed relatively closer to the front rotating shaft 12, this second embodiment achieves the same effect of reducing the length and volume of the treadmill. Thus, the treadmill in accordance with the second embodiment of the present invention requires less installation space, which saves much packing, delivery and storage space and costs. Further, the arrangement of the front lifter 50 allows adjustment of the slope of the treadmill.

In conclusion, the treadmill of the present invention has the characteristics of a simple structure, ease of fabrication and installation, reduced length and volume. Therefore, the object of the present invention can be achieved.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A treadmill, comprising:

a frame comprising a base, a front rotating shaft pivotally connected to said base and a rear rotating shaft pivotally connected to the base, the base comprising a front end portion, a rear end portion opposite to the front end portion, a bottom surface extended from the front end portion to the rear end portion and a top surface opposite to the bottom surface, the front rotating shaft corresponding to the front end portion, the rear rotating shaft corresponding to the rear end portion;

a driving member mounted to said base between said bottom surface and said top surface, the driving member comprising a motor mounted between the front rotating shaft and the rear rotating shaft and located adjacent to the front rotating shaft and a transmission member drivable by the motor to rotate the front rotating shaft;

a running belt mounted around the front rotating shaft and the rear rotating shaft and drivable by the motor to rotate relative to the base; and a rear elevating mechanism mounted to the base and adapted for lifting the rear end portion of the base;

wherein the rear elevating mechanism comprises a rear actuator rotatably mounted between the front rotating shaft and the rear rotating shaft and is located adjacent to the driving member, a pair of rear swinging rods pivotally mounted to the base and drivable by the rear actuator to pivotally rotate relatively to the base, a pair of rear links respectively pivoted to the rear swinging rods, a pair of rear support rods respectively pivoted to the base which are pivotally connected with the rear links and a rear connection rod connected between the rear swinging rods, the rear links each comprising a rear first end respectively pivotally connected to the rear swinging rods and a rear second end disposed opposite to the rear first end and respectively pivotally connected to the rear support rods, the rear support rods being disposed adjacent to the rear end portion, each of the rear support rods comprising a rear pivoting end pivotally connected to the base and a rear swinging end opposite to the rear pivoting end, the rear second ends of the rear links being respectively pivotally connected between the rear pivoting ends and the rear swinging ends.

2. The treadmill as claimed in claim 1, wherein the rear actuator of the rear elevating mechanism comprises a rear motor, a rear lead screw rotatable by the rear motor and a rear screw nut threaded onto the rear lead screw, the rear screw nut comprising a rear pivot connection portion pivotally connected to the rear connection rod, the rear screw nut being drivable by the rear motor to move axially along the rear lead screw and capable of stopping the rear swinging rods, the rear links and the rear support rods from biasing relative to the base.

3. The treadmill as claimed in claim 1, further comprising a front elevating mechanism mounted to the base and adapted for lifting the front end portion of the base.

4. The treadmill as claimed in claim 3, wherein the front elevating mechanism comprises a front actuator rotatably mounted between the front rotating shaft and the rear rotating shaft and located adjacent to the driving member, a pair of front connection rods drivable to move relative to the base by the front actuator, a pair of front links respectively connected to the front connecting rods, a front pivoting rod pivotally mounted to the base and a pair of front support rods connected to the front pivoting rod, the front links each comprising a front first end respectively connected to the front connection rod and a front second end disposed opposite to the front first end and respectively pivotally connected to the front support rods, the front support rods being located adjacent to the front end portion, each the front support rod comprising a front pivoting end connected to the front pivoting rod and a front swinging end opposite to the front pivoting end, the front second ends of the front links being respectively pivotally mounted between the front pivoting ends and the front swinging ends.

5. The treadmill as claimed in claim 4, wherein the front actuator of the front elevating mechanism comprises a front motor, a front lead screw rotatable by the front motor and a front screw nut threaded onto the front lead screw, the front screw nut comprising a front pivot connection portion pivotally connected to the front connection rod, the front screw nut being drivable by the front motor to move axially along the front lead screw, the front screw nut being capable of stopping the front links and the front support rods from biasing relative to the base.

6. A treadmill, comprising:

a frame comprising a base, a front rotating shaft pivoted to the base and a rear rotating shaft pivoted to the base, the base comprising a front end portion, a rear end portion opposite to the front end portion, a bottom surface extended from the front end portion to the rear end portion and a top surface opposite to the bottom surface, the front rotating shaft corresponding to the front end portion, the rear rotating shaft corresponding to said rear end portion;

a rear elevating mechanism mounted to the base and adapted for lifting the rear end portion of the base; and a running belt mounted around the front rotating shaft and the rear rotating shaft and drivable by the motor to rotate relative to the base;

wherein the rear elevating mechanism comprises a rear actuator rotatably mounted between the front rotating shaft and the rear rotating shaft and located adjacent to the driving member, a pair of rear swinging rods pivotally mounted to the base and drivable by the rear actuator to bias relative to the base, a pair of rear links respectively pivotally connected to the rear swinging rods, a pair of rear support rods respectively pivotally connected to the base for pivot connection with the rear links and a rear connection rod connected between the rear swinging rods, the rear links each comprising a rear first end respectively pivotally connected to the rear swinging rods and a rear second end disposed opposite to the rear first end and respectively pivotally connected to the rear support rods, the rear support rods being located adjacent to the rear end portion, each the rear support rod comprising a rear pivoting end pivoted to the base and a rear swinging end opposite to the rear pivoting end, the rear second ends of the rear links being respectively pivotally connected between the rear pivoting ends and the rear swinging ends.

7. The treadmill as claimed in claim 6, further comprising a driving member mounted to the base between the bottom surface and the top surface, the driving member comprising a motor mounted between the front rotating shaft and the rear rotating shaft and located adjacent to the front rotating shaft and a transmission member drivable by the motor to rotate the front rotating shaft.

8. The treadmill as claimed in claim 6, wherein the rear actuator of the rear elevating mechanism comprises a rear motor, a rear lead screw rotatable by the rear motor and a rear screw nut threaded onto the rear lead screw, the rear screw nut comprising a rear pivot connection portion pivoted to the rear connection rod, the rear screw nut being drivable by the rear motor to move axially along the rear lead screw and configured to stop the rear swinging rods, the rear links, and the rear support rods from biasing relative to the base.

9. A treadmill, comprising:

a frame comprising a base, a front rotating shaft pivotally connected to the base and a rear rotating shaft pivotally connected to the base, the base comprising a front end portion, a rear end portion opposite to the front end portion, a bottom surface extended from the front end portion to the rear end portion and a top surface opposite to the bottom surface, the front rotating shaft corresponding to the front end portion, the rear rotating shaft corresponding to said rear end portion;

a front elevating mechanism mounted to the base and adapted for lifting the front end portion of the base; and a running belt mounted around the front rotating shaft and the rear rotating shaft and drivable by the motor to rotate relative to said base;

wherein the front elevating mechanism comprises a front actuator rotatably mounted between the front rotating shaft and the rear rotating shaft and located adjacent to the driving member, a pair of front connection rods drivable to move relative to the base by the front actuator, a pair of front links respectively connected to the front connecting rods, a front pivoting rod pivotally mounted to the base and a pair of front support rods connected to the front pivoting rod, the front links each comprising a front first end respectively connected to the front connection rod and a front second end disposed opposite to the front first end and respectively pivotally connected to the front support rods, the front support rods being located adjacent to the front end portion, each the front support rod comprising a front pivoting end connected to the front pivoting rod and a front swinging end opposite to the front pivoting end, the front second ends of the front links being respectively pivotally mounted between the front pivoting ends and the front swinging ends.

10. The treadmill as claimed in claim 9, further comprising a driving member mounted to the base between the bottom surface and the top surface, the driving member comprising a motor mounted between the front rotating shaft and the rear rotating shaft and located adjacent to the front rotating shaft and a transmission member drivable by the motor to rotate said front rotating shaft.

11. The treadmill as claimed in claim 9, wherein the front actuator of the front elevating mechanism comprises a front motor, a front lead screw rotatable by the front motor and a front screw nut threaded onto the front lead screw, the front screw nut comprising a front pivot connection portion pivotally connected to the front connection rod, the front screw nut being drivable by the front motor to move axially along the front lead screw, the front screw nut being capable of stopping the front links and the front support rods from biasing relative to the base.

12. A treadmill, comprising:

a frame comprising a base, a front rotating shaft pivotally connected to said base and a rear rotating shaft pivotally connected to the base, the base comprising a front end portion, a rear end portion opposite to the front end portion, a bottom surface extended from the front end portion to the rear end portion and a top surface opposite to the bottom surface, the front rotating shaft corresponding to the front end portion, the rear rotating shaft corresponding to the rear end portion;

a driving member mounted to said base between said bottom surface and said top surface, the driving member comprising a motor mounted between the front rotating shaft and the rear rotating shaft and located adjacent to the front rotating shaft and a transmission member drivable by the motor to rotate the front rotating shaft;

a running belt mounted around the front rotating shaft and the rear rotating shaft and drivable by the motor to rotate relative to the base; and a front elevating mechanism mounted to the base and adapted for lifting the front end portion of the base;

wherein the front elevating mechanism comprises a front actuator rotatably mounted between the front rotating shaft and the rear rotating shaft and located adjacent to the driving member, a pair of front connection rods drivable to move relative to the base by the front actuator, a pair of front links respectively connected to the front connecting rods, a front pivoting rod pivotally mounted to the base and a pair of front support rods connected to the front pivoting rod, the front links each comprising a front first end respectively connected to the front connection rod and a front second end disposed opposite to the front first end and respectively pivotally connected to the front support rods, the front support rods being located adjacent to the front end portion, each the front support rod comprising a front pivoting end connected to the front pivoting rod and a front swinging end opposite to the front pivoting end, the front second ends of the front links being respectively pivotally mounted between the front pivoting ends and the front swinging ends.

13. The treadmill according to claim 12, wherein the front actuator of the front elevating mechanism comprises a front motor, a front lead screw rotatable by the front motor and a front screw nut threaded onto the front lead screw, the front screw nut comprising a front pivot connection portion pivotally connected to the front connection rod, the front screw nut being drivable by the front motor to move axially along the front lead screw, the front screw nut being capable of stopping the front links and the front support rods from biasing relative to the base.

* * * * *